US008591014B2

(12) United States Patent
Leiser et al.

(10) Patent No.: US 8,591,014 B2
(45) Date of Patent: Nov. 26, 2013

(54) FLUIDIC INTERFACE

(75) Inventors: Judson M. Leiser, Corvallis, OR (US); Karen A. St Martin, Lebanon, OR (US); Patrick V. Boyd, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 197 days.

(21) Appl. No.: 13/026,230

(22) Filed: Feb. 12, 2011

(65) Prior Publication Data

US 2012/0204966 A1 Aug. 16, 2012

(51) Int. Cl.
*B41J 2/17* (2006.01)
*B41J 2/175* (2006.01)

(52) U.S. Cl.
USPC ..... 347/86; 347/84

(58) Field of Classification Search
None
See application file for complete search history.

(56) References Cited

U.S. PATENT DOCUMENTS

| | | | | |
|---|---|---|---|---|
| 6,164,771 | A | 12/2000 | Eckard et al. | |
| 6,328,424 | B1 | 12/2001 | Denton et al. | |
| 6,422,693 | B2 | 7/2002 | Pawlowski, Jr. et al. | |
| 6,877,846 | B2 | 4/2005 | Fellingham et al. | |
| 7,004,564 | B2 * | 2/2006 | Steinmetz et al. | 347/49 |
| 2008/0106575 | A1 * | 5/2008 | Shimizu et al. | 347/49 |

* cited by examiner

*Primary Examiner* — Matthew Luu
*Assistant Examiner* — Renee I Wilson

(57) ABSTRACT

An embodiment of this disclosure relates to a fluidic interface for a fluid cartridge comprising a single cast comprising a fluidic needle.

12 Claims, 7 Drawing Sheets

FLUIDIC INTERFACE

BACKGROUND OF THE INVENTION

A fluidic interface is arranged to connect to a fluid cartridge. The interface and the cartridge have corresponding inter-engaging parts designed to facilitate interconnection. The fluidic interface is arranged to connect the fluid cartridge to a further fluid channel. When the fluid cartridge is connected to the fluidic interface, the fluidic interface guides the fluid from the cartridge to a corresponding further fluid channel.

BRIEF DESCRIPTION OF THE DRAWINGS

For the purpose of illustration, certain embodiments of the present invention will now be described with reference to the accompanying diagrammatic drawings, in which.

DETAILED DESCRIPTION

In the following detailed description, reference is made to the accompanying drawings. The embodiments in the description and drawings should be considered illustrative and are not to be considered as limiting to the embodiment or element described. Multiple embodiments may be derived from the following description and/or drawings through modification, combination or variation of certain elements. Furthermore, it may be understood that other embodiments or elements that are not literally disclosed may be derived from the description and drawings by a person skilled in the art.

Figure 1:
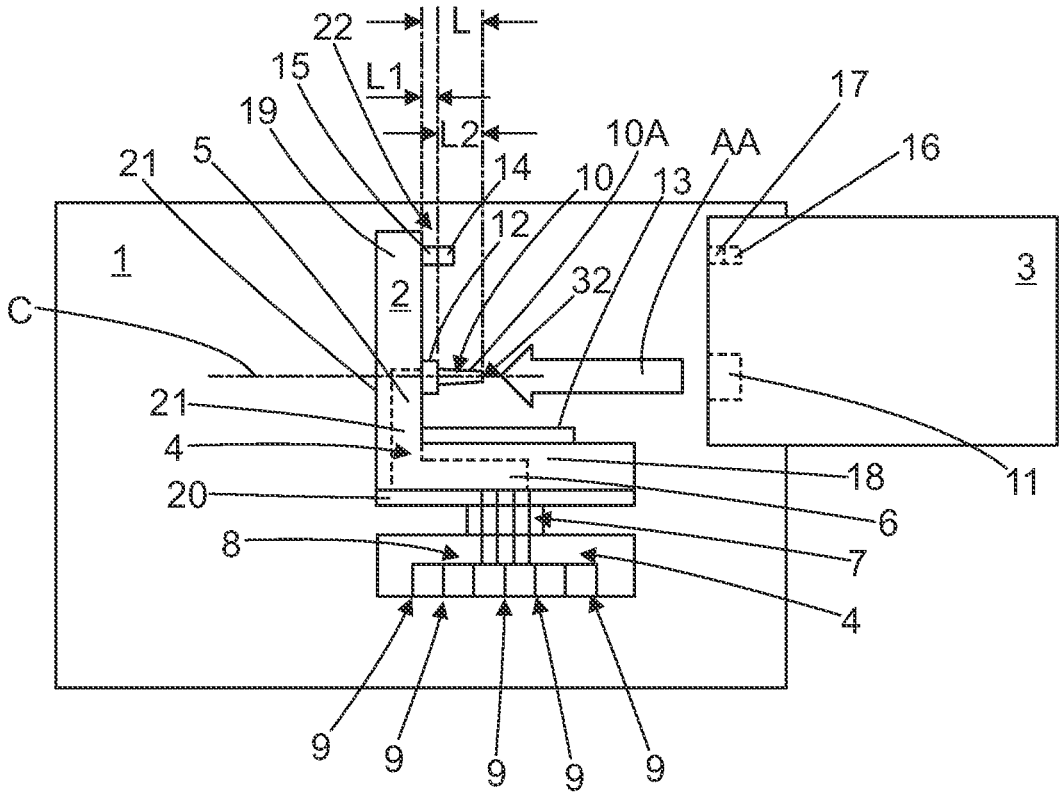
FIG. 1 shows a diagram of an embodiment of a fluid ejection device and a fluid cartridge in side view.

FIG. 1 shows a diagram of an embodiment of a fluid ejection device 1. The fluid ejection device 1 comprises a fluidic interface 2 for receiving a fluid cartridge 3. The fluid ejection device 1 comprises fluidic channels 4. In the shown embodiment, the fluidic channels 4 comprise interface fluid channels 5, further fluid channels 7, a manifold 8, and nozzles 9. In further embodiments, further elements may be included, such as filtration elements, regulation elements, etc. The fluidic interface 2 is arranged to enable a fluidic connection between the fluid cartridge 3 and the nozzles 9.

Certain examples of the fluid cartridges 3 are consumable products, wherein the fluidic interface 2 is arranged to allow repetitive connection and disconnection of the fluid cartridges 3. A fluid cartridge 3 may be replaced by a newer fluid cartridge 3. An example of a fluid ejection device 1 is a printer. An example of a fluid is ink. In an embodiment, the interface fluid channels 5 that are present in the interface 2 comprise ink chambers 6.

The fluidic interface 2 comprises a fluidic needle 10. The fluidic needle 10 is arranged to be inserted in a corresponding opening 11 of the fluid cartridge 3 to establish a fluidic connection between the cartridge 3 and the ejection device 1. An embodiment of the needle 10 comprises a datum 12 at the base of the needle 10, while the rest 10A of the needle protrudes away from the datum 12. The diameter of the datum 12 is larger than the diameter of the protruding part 10A of the needle 10. The datum 12 is arranged at the base of the needle 10. In an embodiment, the datum 12 is concentric with the needle 10. The datum 12 may be arranged to center the cartridge opening 11 with respect to the needle 10. An embodiment of the datum 12 provides stability to the needle 10. The concentric datum 12 may maintain the cartridge 3 in position with respect to the needle 10. The protruding part of the needle 10 is arranged to open the cartridge opening 11, for example by opening a valve or septum or the like. The protruding part 10A of the needle 10 may have a substantially longitudinal, conical and truncated shape, around a central axis C.

The needle 10 has a total length L, as measured along its central axis C. In an embodiment, the needle 10 has a total length L between approximately 6 and approximately 40 mm, or between approximately 8 and approximately 20 mm. In an embodiment, the needle 10 has a total length L of approximately 17.7 mm. In an embodiment, the concentric datum 12 has a length L1 of between approximately 2 and approximately 20 mm, or between approximately 3 and approximately 15 mm. In an embodiment, the concentric datum 12 has a length L1 of approximately 8.1 mm. In an embodiment, the protruding part 10A of the needle 10 has a length L2 of between approximately 3 and approximately 25 mm, or between approximately 4 and approximately 18 mm. In an embodiment, the protruding part of the needle 10 has a length L2 of approximately 9.6 mm. In further embodiments, other lengths L, L1, L2 may apply, for example depending on the size of the fluid ejection device 1, fluidic interface 2, and/or cartridge inner volume. The needle 10 may be shorter or longer and other ratios may apply between the length L1 of the datum 12 and the length L2 of the protruding part 10A of the needle 10. For example the length L1 of the datum 12 may be relatively longer or shorter as compared to the protruding part 10A of the needle 10.

A guide 13 is provided, at a distance from the needle 10. In the shown embodiment, the guide 13 extends close to the needle 10. The guide 13 is arranged for guiding the fluid cartridge 3 for insertion of the needle 10 into the fluid cartridge 3 when the cartridge 3 is moved in the direction of the needle 10.

In an embodiment, the fluidic interface 2 comprises multiple needles 10 for receiving multiple respective cartridges 3, wherein each cartridge 3 contains a specific predetermined fluid. In an embodiment, the fluid ejection device 1 is configured to eject the predetermined fluid through predetermined nozzles 9. This implies that the cartridge 3 may be connected to a corresponding needle 10. In one embodiment, the interface 2 comprises a keying element or first datum element 14 for each needle 10 to aid in guiding only a predetermined cartridge 3 to the predetermined needle 10.

In an embodiment, the interface 2 comprises a first electrical connector 15 next to the first datum element 14. The cartridge 3 comprises a corresponding second datum element 16 and a corresponding second electrical connector 17, respectively. In an embodiment, the first and second datum elements 14, 16 are arranged to inter-engage, so that the first and second electrical connector 15, 17 maintain electrical connection. In an embodiment, the electrical connection is needed for activating the flow of fluid through the needle 10 and the fluidic channels 4.

In the shown embodiment, the fluidic interface 2 comprises a bottom plate 18 and a standing wall 19. The fluidic needle 10 comprises a cantilever construction protruding away from the standing wall. The fluidic needle 10 protrudes from the standing wall 19. The concentric datum 12 protrudes from the standing wall 19, at the base of the needle 10. The guide 13 protrudes from the bottom plate 18. In an embodiment, the bottom plate 18 and the standing wall 19, the guide 13 and the needle 10, form part of an integrally molded plastic cast 21. In other embodiments, the single cast 21 may comprise a metal.

The single plastic cast 21 is an integrally molded part, molded in a single mold. The interface fluid channels 5 are integrally molded in the bottom plate 18 and the standing wall 19. In an embodiment, the interface fluid channels 5 comprise fluid chambers 6. A first fluid chamber portion 6 may be arranged in the standing wall 19 and a second fluid chamber portion 6 in the bottom plate 18. The interface fluid channel 5 is in fluidic connection with a respective needle 10 and a further fluid channel 7. An intermediate fluidic member 20 may be provided for guiding and/or sealing the fluidic connection between the interface 2 and further fluid channels 7. The further fluid channels 7 may partly extend through the intermediate fluidic member 20. The intermediate fluidic member 20 may be arranged for substantially fluid tight transportation of the fluid to the nozzles 9.

Figure 2:
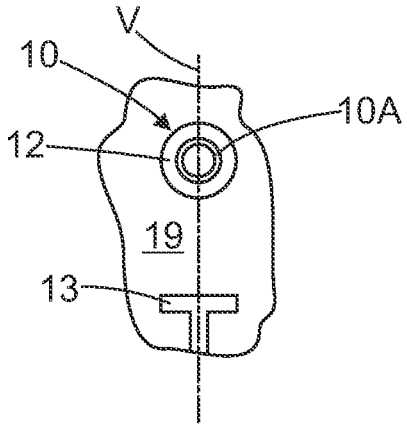
FIG. 2 shows a front view of a portion of a fluidic interface.

FIG. 2 shows a front view of a part of the interface 2, onto the standing wall 19. As can be seen, the fluidic needle 10 and the guide 13 are aligned with respect to in a common vertical plane V. Both extend in the vertical plane V. This may allow for better alignment of the cartridge 3 with respect to the needle 10. The guide 13 may comprise a rail or the like for guiding the cartridge 3 along the needle 10 until the cartridge opening 11 engages the concentric datum 12 and the fluidic connection is established. In an embodiment, the guide 13 comprises a T-rail. The concentric datum 12 and the T-rail may together retain the cartridge 3 with respect to the needle 10.

Figure 3:
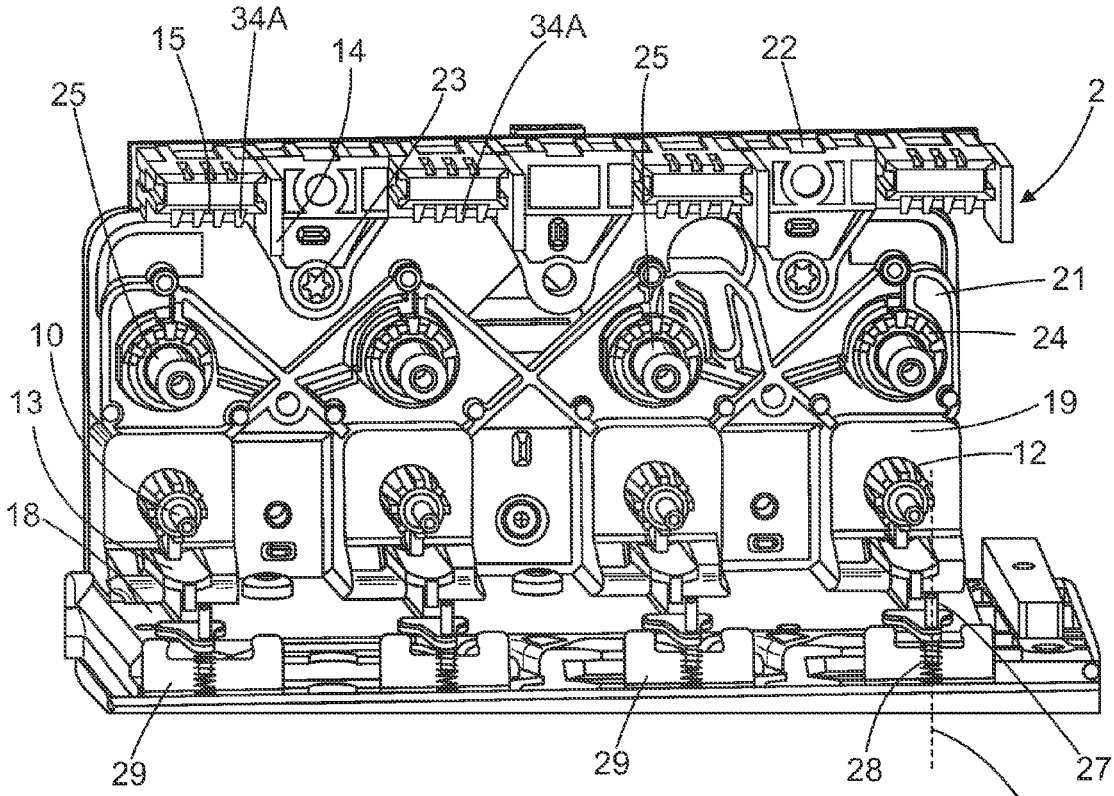
FIG. 3 shows a perspective view of an embodiment of a fluidic interface.

FIG. 3 shows an embodiment of a fluidic interface 2. The fluidic interface 2 comprises a single plastic cast 21 and a connector arrangement 22. The connector arrangement 22 is mounted on top of the standing wall 19 of the single cast 21, opposite to the bottom plate 18. Attachment members 23 such as screws, click fingers, or adhesives may be used to connect the connector arrangement 22 to the single cast 21. When inserting the cartridge 3, the cartridge 3 engages the guide 13 on the bottom of the cartridge 3 and the first electrical connector 15 connects to the second electrical connector 17 at the top of the cartridge 3. The first electrical connector 15 may comprise multiple electrodes 34A, for example at least two, at least three or at least four electrodes 34A. The second electrical connector 17 may comprise the same amount of connection pads 34B for contacting the electrodes 34A (e.g. see FIG. 8).

In an embodiment, the connector arrangement 22 further comprises the first datum element 14 that is arranged to guide the respective first and second electrical connectors 15, 17 to interconnect, and to maintain their connected position. In an embodiment, the first datum element 14 may have a keying function so as to guide and maintain only correspondingly equipped cartridges 3. In the shown embodiment, the first datum element 14 comprises an arm. The arm may have a plate- or pin like shape and extending downwards towards the bottom plate 18. The second datum element 16 may comprise slot for receiving the first datum element 16 (e.g. see FIG. 8).

In an embodiment, the single cast 21 comprises a secondary datum feature 24. The secondary datum feature 24 forms a concentric base of a secondary fluidic needle 25. The secondary fluidic needle 25 protrudes from the secondary datum feature 24, away from the standing wall 19, for example in a direction approximately parallel to the first fluidic needle 10. A central axis of the secondary fluidic needle 25 may extend in approximately the same direction as the central axis C of the fluidic needle 10, at least so that both needles 10, 25 can be inserted in the corresponding cartridge openings when moving the cartridge 3 along the guide 13. In the shown embodiment, the secondary fluidic needle 25 extends through a hole 26 in the secondary datum feature 24. In the shown embodiment, the secondary fluidic needle 25 is not part of the single cast 21. In an embodiment, the secondary fluidic needle 25 is connected to secondary fluid channels such as air ducts. The secondary fluidic needle 25 may be an air needle for transporting air to and from the cartridge 3.

In the shown embodiment, the interface 2 comprises a latch 27. The latch 27 is connected to the bottom plate 18. The latch 27 is connected to the bottom plate 18 so that it can be rotated around a rotation axis A. A resilient member 28 such as a spring may be provided for biasing the latch 27 towards a home position. In a latched condition, the latch 27 may engage the cartridge 3 so that the cartridge 3 is blocked from ejection out of the fluid ejection device 1. Furthermore, a latch stop 29 is provided.

In the shown embodiment, the interface 2 has four guides 13, four fluidic needles 10, four secondary fluidic needles 10, four latches 27, and four electrical connectors 15, as well as corresponding datum or keying arrangements 12, 14. The interface 2 is arranged to receive four corresponding cartridges 3. In use, each cartridge 3 may pertain to a specific fluid type, such as an ink color. Each needle 10 may deliver the specific fluid type to the corresponding fluid channel 4 and to the corresponding preconfigured nozzle 9. In other embodiments, the interface 2 is arranged to receive other numbers of cartridges 3. Each cartridge 3 may contain one or more fluid types, and one or more openings 11 for each fluid type, for receiving one or more corresponding fluidic needles 10.

Figure 4:
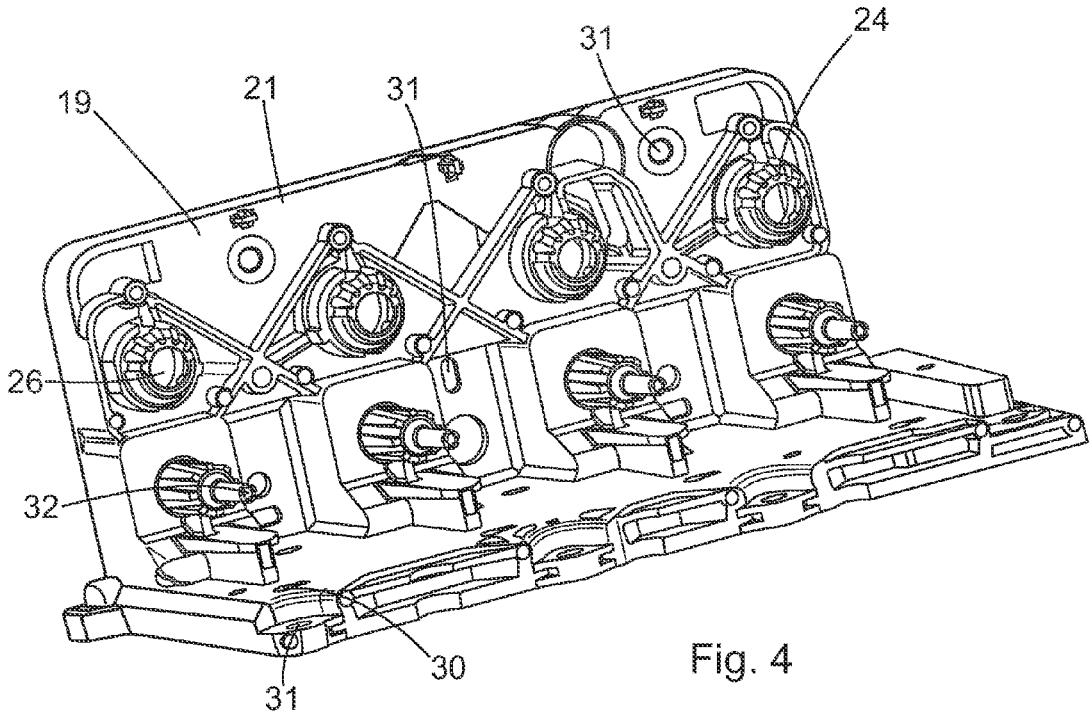
FIG. 4 shows a perspective view of an embodiment of a single cast of the fluidic interface of FIG. 3.

FIG. 4 shows the single plastic cast 21 of FIG. 3. The single cast 21 comprises multiple fluidic needles 10 and corresponding guides 13. The fluidic needles 10 are integrally molded with the bottom plate 18 and standing wall 19, using the same plastic. Also the guides 13 are integrally molded with the bottom plate 18 and standing wall 19. The single cast 21 may be relatively cost efficient, integrating several functions and features of the interface 2.

In an embodiment, the single cast 21 comprises openings 30 for latches 26, as well as multiple openings 31 for respective attachment members for attaching the electrical connector arrangement 22, the intermediate fluidic member 20, and/or other parts.

The single plastic cast 21 may be molded using a suitable plastic or metal. In an embodiment, a relatively low cost plastic may be chosen. In an embodiment, the single plastic cast 21 comprises a plastic having a relatively low flexural modulus. In an embodiment the plastic of the single cast 21 has a flexural modulus of approximately 30,000 MPa or less at approximately 22.8 degrees Celsius, or 2,000 MPa or less at approximately 22.8 degrees Celsius. In an illustrative example, the material comprises PET (Polyethylene-Terephthalate) having a flexural modulus of approximately 5378 MPa. For certain embodiments, plastics having higher moduli than the moduli mentioned above may be suitable as well.

In a further embodiment, an end 32 of the fluidic needle 10 has a cross sectional moment of inertia of approximately 10 $mm^4$ or less, of approximately 8 $mm^4$, or of approximately 6 $mm^4$ or less. For example, the cross sectional moment of inertia of the end 32 of the needle 10 may be approximately 1.14 $mm^4$. The cross sectional moment of inertia of the concentric datum 12 may be more approximately ten times or more than the cross sectional moment of inertia of the end 32 of the needle 10. For example, the datum 12 has a cross sectional moment of inertia of between approximately 20 $mm^4$ and approximately 300 $mm^4$. In one embodiment, a part of the datum 12 has a cross sectional moment of inertia of approximately 71.9 $mm^4$. In another embodiment, a portion of the datum 12 has a cross sectional moment of inertia of approximately 124 $mm^4$ and another portion having a cross sectional moment of inertia of approximately 59.7 $mm^4$.

The concentric datum 12 may be arranged to align the needle 10 with the opening 11 of the cartridge 3. At insertion, the opening 11 may center itself around the concentric datum 12 so that the cartridge 3 may position itself with respect to the needle 10. In an inserted condition, the concentric datum 12 engages the inner walls of the opening 11. The concentric datum 12 may bear a load of the cartridge 3, and reduce a load that would otherwise be put onto the protruding part 10A of the needle 10. The needle 10 may have at least two parts, having significantly different cross sectional moments of inertia. This may allow for integrally molding, in a cost efficient manner, the needle 10 with the rest of the single cast 21.

When the needle 10 connects to the cartridge 3, it may interact with an opening mechanism of the cartridge 3, for example a certain type of valve or septum. In an embodiment, the end 32 of the needle 10 interacts with a ball septum. In the latter embodiment, a 1 pound load at the end 32 of an 18 millimeter needle of PET (Polyethylene-Terephthalate) with a Modulus of Elasticity of 5378 MPa, as induced by the ball septum at insertion, would deflect 0.32 mm, in certain test conditions. In contrast, a needle 10 that comprises a concentric datum 12 at the base, the datum 12 having a length of approximately 8.1 mm and a cross sectional moment of 59.7 $mm^4$, and the protruding part 10A of the needle 10 having a cross sectional moment of inertia of approximately 1.14 $mm^4$ for approximately 9.6 mm, would deflect only 0.03 mm.

The secondary datum 24 aids in further support and guidance of the cartridge 3. In an embodiment, the T-rail guide 13 limits the degrees of freedom of the cartridge 3 to one. The T-rail guide 13 limits the movement of the cartridge 3 to a translation in the direction AA and prevents other rotations or translations, excluding movements made possible by material tolerances and margins.

It is noted that tolerances and margins that are inherently present in integrally molded products could lead to higher loads on the fluidic needle 10. However, in certain embodiments of this disclosure, this was overcome by the arrangement of the guide 13 and datum 12, allowing for relatively precise guiding and loading of the cartridge 3. Therefore, in an embodiment, lower requirements can be set for the material and construction of the fluidic needle 10, such as molding it integrally with the interface 2, which reduces the complexity of the interface 2.

Figure 5:
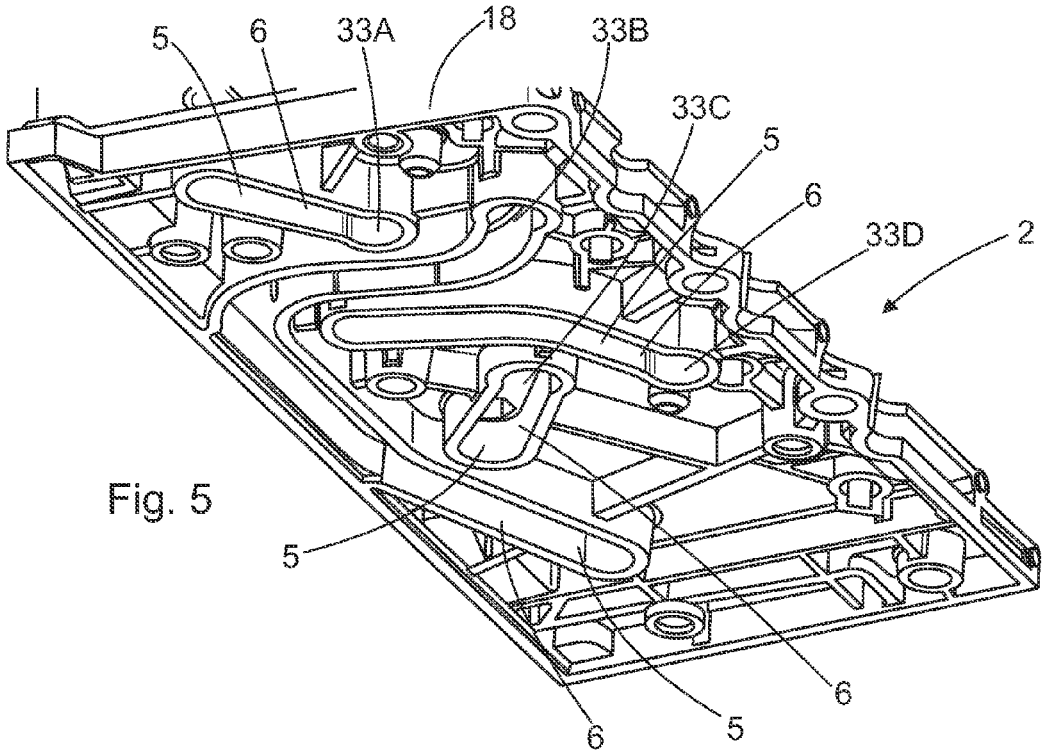
FIG. 5 shows a perspective view of an embodiment of the single cast of FIG. 4, with a view on its bottom.

FIG. 5 shows a bottom view of the bottom plate 18 of the single cast 21. The bottom plate 18 comprises interface fluid channels 5. In the shown embodiment, the fluid channels comprise fluid chambers 6 that are provided in the bottom plate 18. Each of the interface fluid channels 5 is in fluidic connection with a respective fluidic needle 10. In an embodiment, each of the interface fluid channels 5 pertain to a fluid type, for example an ink color. In an embodiment certain datum and keying features are provided to facilitate that only corresponding cartridge 3 of the specific fluid type exchange fluid with the interface fluid channel 5.

The interface fluid channels 5 may comprise slots in the bottom plate 18 of the single cast 21. The interface fluid channels 5 are integrally molded in the single cast 21. The interface fluid channels 5 are arranged to direct the fluid from the needle 10 to respective fluid output locations 33A, 33B, 33C, 33D in the bottom of the bottom plate 18.

Figure 6:
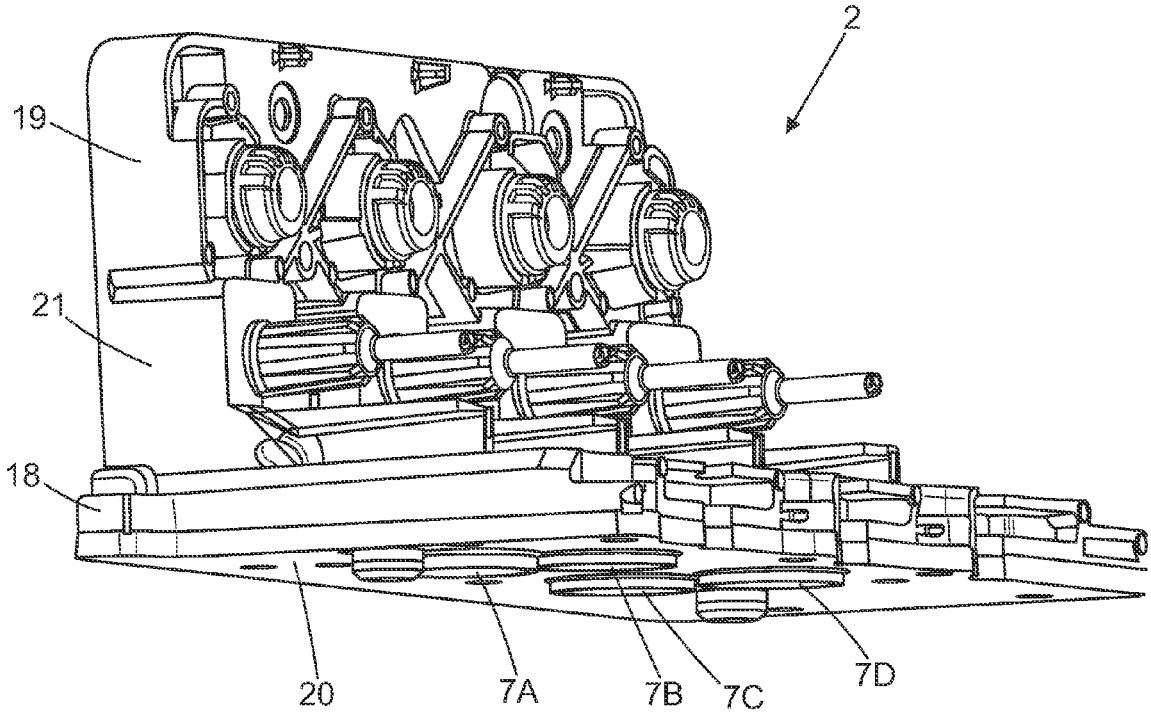
FIG. 6 shows a perspective view of the embodiment of the single cast of FIGS. 3, 4 and 5, and an intermediate fluidic member.

The interface fluid channels 5 are arranged for connection to further fluid channels 7, pertaining to the same fluid type. As can be seen from FIG. 6, the respective output locations 33A, 33B, 33C, 33D of the single cast 21 fluidically connect to respective further fluid channels 7A, 7B, 7C, 7D that are provided in the intermediate fluidic member 20 and/or a fluid ejection assembly 39 (e.g. see FIG. 9). The interface fluid channels 5 are arranged to redirect fluid to the output locations 33A, 33B, 33C, 33D, that in turn fluidically connect to the respective further fluid channels 7A, 7B, 7C, 7D. In the shown embodiment, the intermediate fluidic member 20 comprises a plate-shaped fluid seal having openings that are part of the further fluid channels 7 for directing the fluid to the manifold 8 and/or the nozzles 9.

Figure 7:
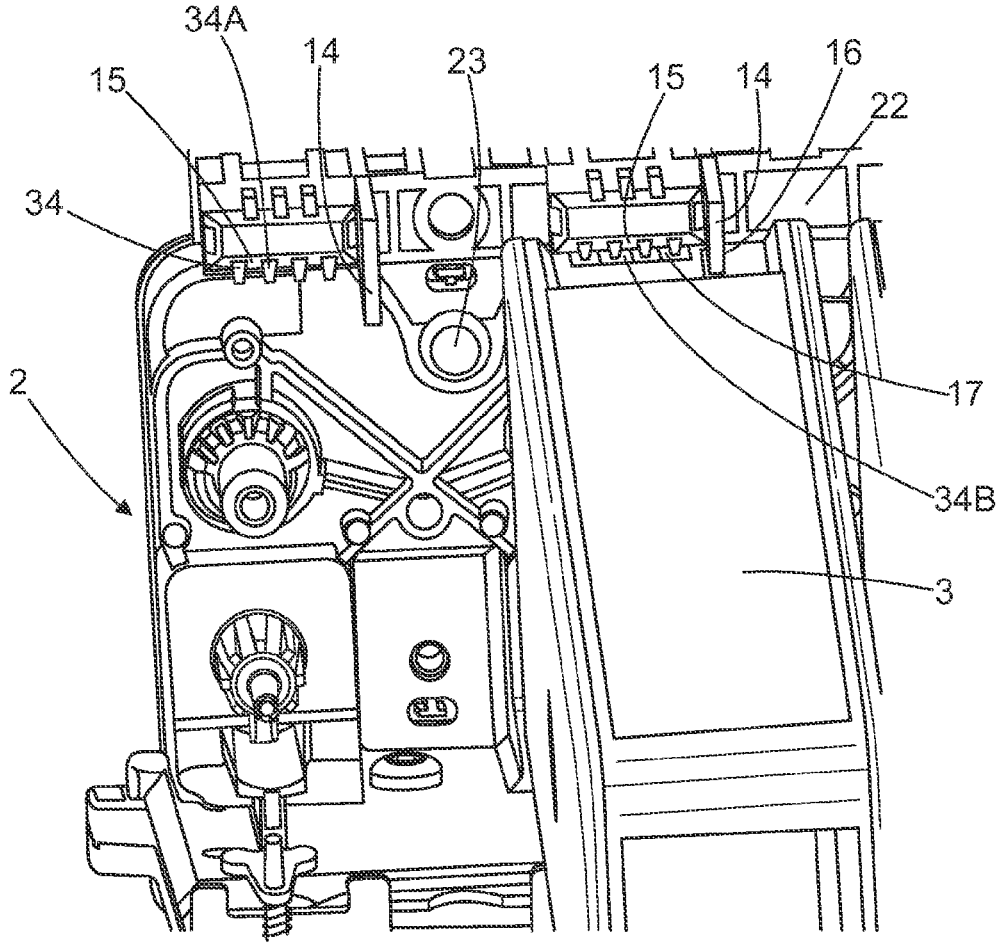
FIG. 7 shows a perspective view of a portion the embodiment of the fluidic interface of FIG. 3, with a connector assembly mounted on top.

FIG. 7 shows a detail of a cartridge 3 connected to one of the needles 10 of the interface 2, wherein a fluidic needle 10 next to the connected cartridge 3 is not connected to any cartridge 3. The second electrical connector 17 and the second datum element 16 of the cartridge 3 engage the first electrical connector 15 and the first datum element 14, respectively, of a corresponding portion of the interface 2. In the shown embodiment, the first datum element 14 comprises a relatively rigid arm and the second datum element 16 comprises a corresponding slot. The arm extends next to the first electrical connector 15 and points towards the bottom plate 18. The electrodes 34A may also protrude downward, towards the bottom plate 18. The electrodes 34A may comprise resilient electrodes. When connecting the cartridge 3, the arm slides in the corresponding slot of the cartridge 3, while the electrodes 34A of the first electrical connector 15 slide over corresponding contact pads 34B of the second electrical connector 17. The first datum element 14 is arranged to guide the cartridge 3 so that the respective electrodes 34A are aligned with the corresponding connection pads 34B.

Figure 8:
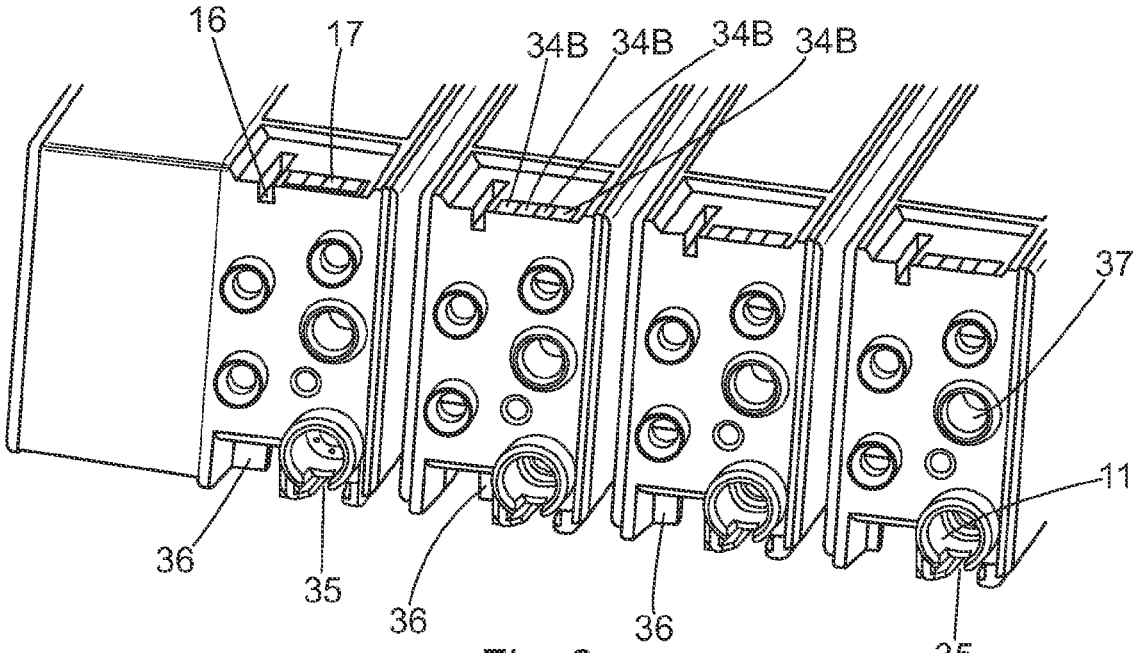
FIG. 8 shows a perspective view of portions of fluid cartridge embodiments, with a view on their front face that is adapted to interface with the fluidic interfaces shown in FIGS. 3 and 7.

FIG. 8 shows embodiments of four cartridges 3 that are arranged for connection to an embodiment of a fluidic interface 2, for example the embodiments shown in FIGS. 3 and 7. The embodiment shows that the second electrical connectors may comprise four electrical connection pads 34B. The cartridges 3 may comprise T-shaped guide receiving slots 35 at their respective bottoms for engaging the T-rail guide 13 of the fluidic interfaces 2. Therewith, the movement along the guide 13 is limited to a one directional translation.

The cartridge 3 may comprise a number of fluidic openings in its front face. A first fluidic opening 11 is arranged to interconnect to the fluidic needle 10. The first fluidic opening 11 may be arranged close to and on top of the guide receiving slot 35. A secondary fluidic opening 37 may be provided for receiving the secondary fluidic needle 25. The cartridges 3 may have different widths, for example corresponding to a container volume for containing the fluid of the cartridge 3. Further dummy and ventilation openings and further alignment features may be provided in the front face.

Figure 9:
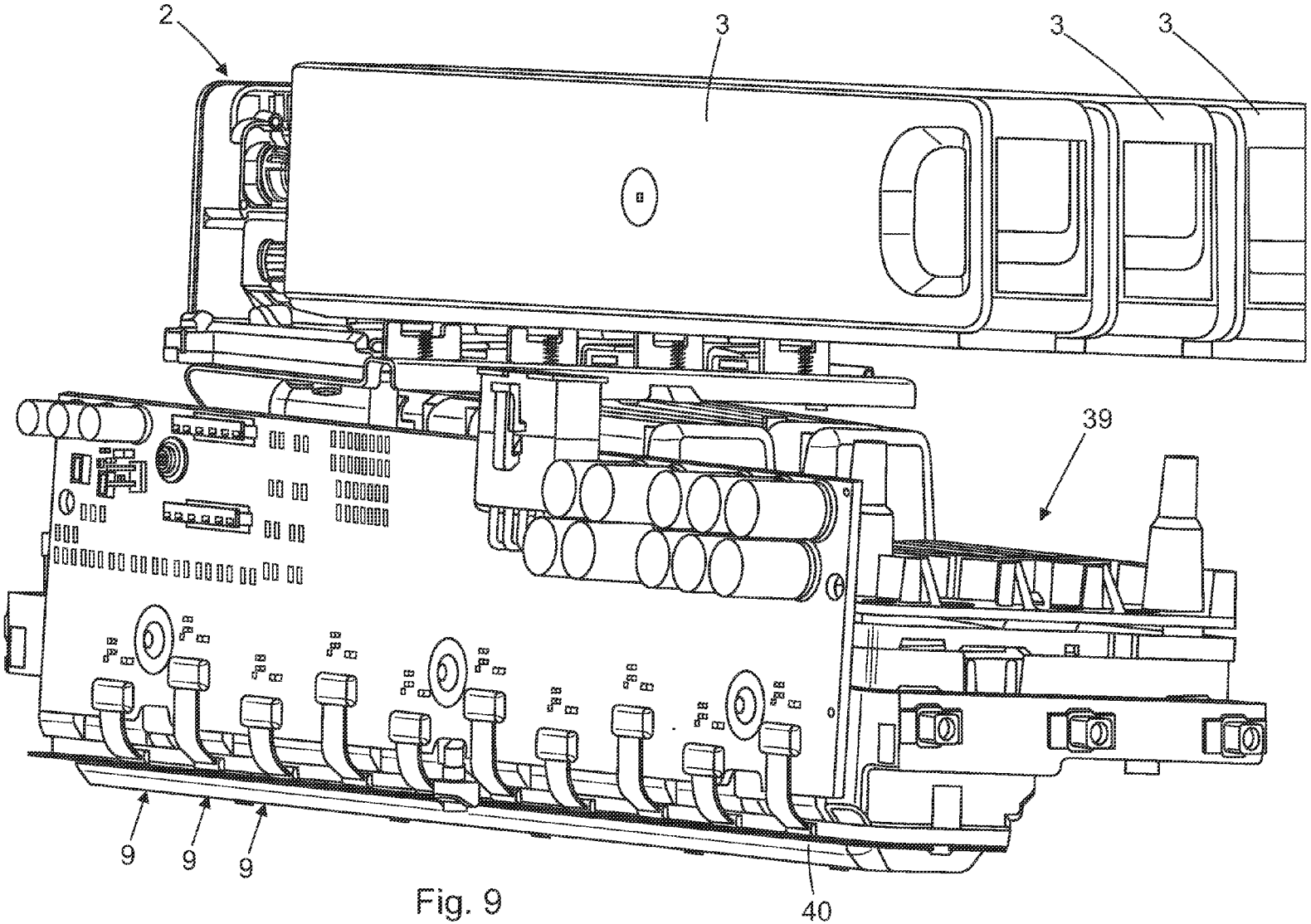
FIG. 9 shows a portion of an embodiment of a fluid ejection device and cartridges, the fluid ejection device comprising an embodiment of a fluidic interface.

FIG. 9 shows a part of the fluid ejection device 1. A number of cartridges 3 is shown that is connected to the fluidic interface 2. The fluidic interface 2 is connected to the fluid ejection assembly 39. In this embodiment, the fluid ejection assembly comprises a fluid ejection bar 40. The fluid ejection bar 40 comprises nozzles 9. In other embodiments, a fluid ejection scanner may be provided. The shown embodiment comprises relatively long cartridges 3, forming cantilever constructions. The cartridges 3 may put a load on the concentric datum 12 and/or the secondary datum feature 24. The concentric datum 12 and the guide 3 may hold the cartridge 3 and may prevent further loads being put on the protruding part 10A of the fluidic needle 10. The fluidic needle 10 may be repetitively connected and disconnected with the cartridge 3 while remaining functional.

The shown embodiment shows no connector arrangement 22, but the same principle could apply to a fluidic interface 2 having a connector arrangement 22. In another not shown embodiment, an additional guide and/or support assembly may be connected to the interface 2 for aiding in guiding and/or supporting the cartridges 3.

Figure 10:
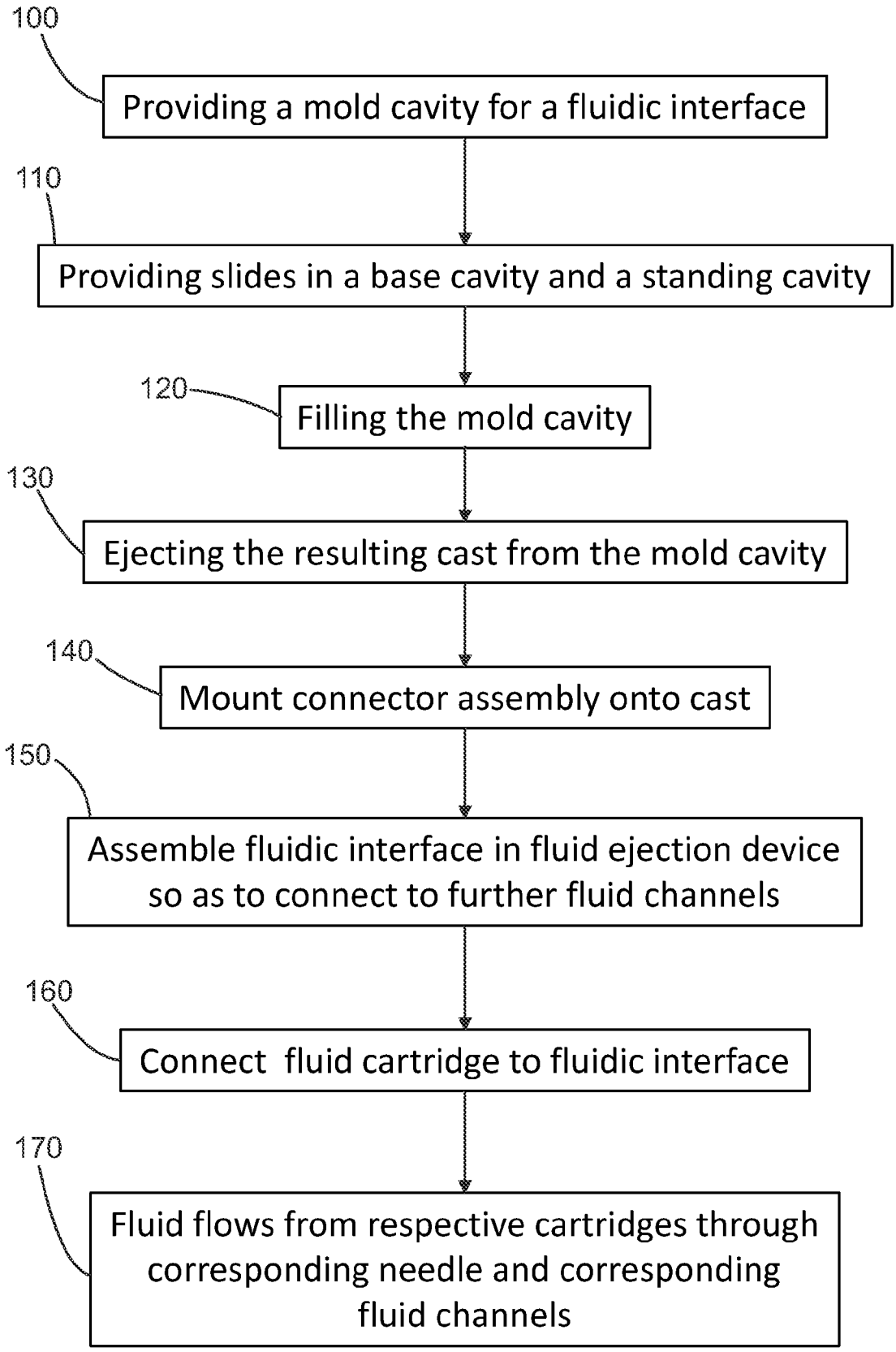
FIG. 10 shows a flow chart of an embodiment of a method of manufacturing and using a fluid ejection device.
Figure 11:
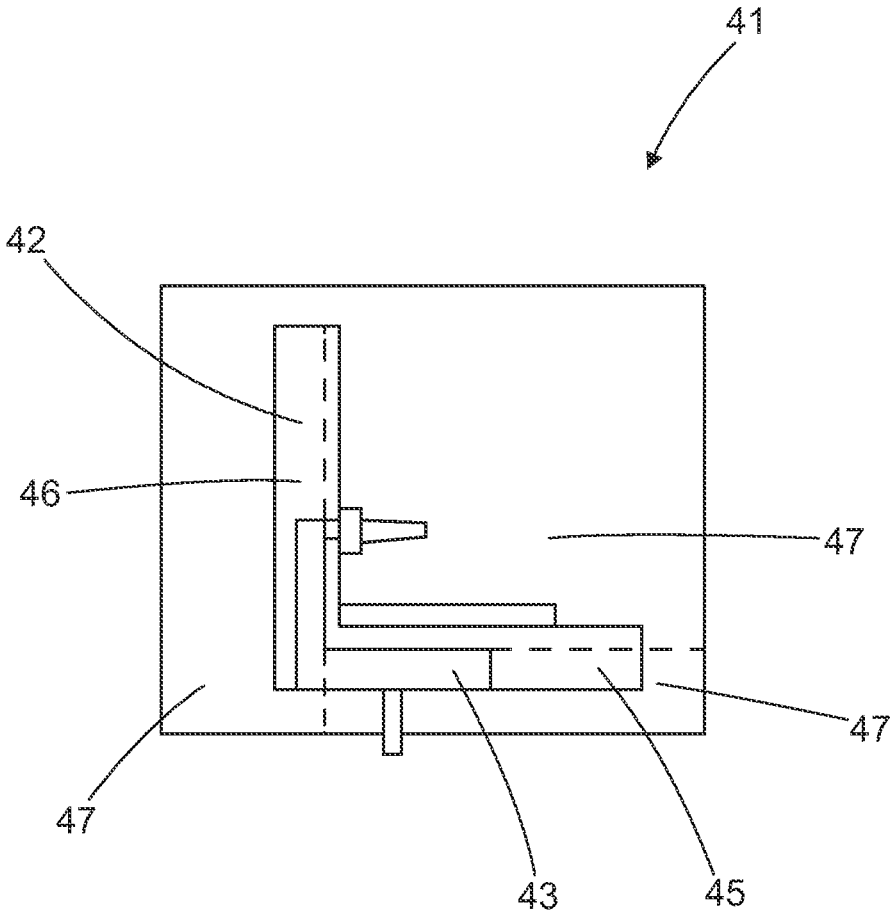
FIG. 11 shows a diagrammatic drawing of an embodiment of a mold for manufacturing an embodiment of a fluidic interface.

FIG. 10 shows an embodiment of a method of manufacturing and using a fluidic interface 2. FIG. 11 shows a diagram of an embodiment of a mold 41 that may be used in such manufacturing method. In this context, molding may comprise any molding process, for example a thermoplastic molding process, injection molding, blow molding, compression molding, hybrid molding processes, etc.

In step 100 of the manufacturing method, a mold cavity 42 is provided, in between mold plates 47. The cavity 42 has the shape of the fluidic interface 2, for providing the single cast form 21 of the fluidic interface 2. Slides 43 are provided to provide the respective interface fluid channels 5 in the single cast 21, as indicated by step 110. The slides 43 may be provided in the base cavity 45, pertaining to the bottom plate 18, and the standing cavity 46, pertaining to the standing wall 19. The slides 43 are designed to form the interface fluid channels 5. In step 120 the mold cavity 41 is filled with the plastic. In step 120, the fluidic needle 10, the guide 13, and the fluidic channels 5 are integrally molded. In step 130, the resulting single cast 21 may be ejected by moving mold plates 47 away from each other, as well as retrieving the slides 43 and/or moving further mold parts as necessary.

In step 140, the connector assembly 22 is mounted onto the standing wall 19 of the single cast 21. In step 150, the fluidic interface 2 is assembled in the fluid ejection device 1, onto the fluid ejection assembly 39. The cast 21 is connected to the fluid ejection assembly 39. The needles 10 are brought in fluidic connection with the further fluid channels 7.

In step 160, the fluid cartridge 3 is connected to the fluid ejection device 1. The cartridge 3 is guided along the guide 13. The needle 10 is inserted into the cartridge opening 11. The fluid in the cartridge 3 is connected with the interface fluid channels 5 of the single cast 21. In use, each fluid type flows through the corresponding interface fluid channels 5 of the single cast 21, being guided to the proper further channels 7, and the proper nozzles 9.

In an embodiment, the fluidic interface 2 provides for a relatively good alignment of the datum 12, the secondary datum feature 25, the guide 13 and/or the first datum element 14, with respect to the needle 10. It was shown, that a functional single cast 21 can be obtained, having tolerances between the features that would still allow a fully functional integrally molded protruding needle 10. While the functional requirements for such needle 10 may be high, a relatively large choice of freedom may be obtained for the choice of the material. An interface 2 of reduced complexity and reduced cost may be achieved. The needle 10 is suitable for repetitive insertion into cartridges 3. The shown interface allows for a wide range of widths and lengths of cartridges 3 to be repetitively connected to the fluidic interface 2. In an embodiment, the fluidic interface 2 and/or the single cast 21 can be readily connected to a fluid ejection assembly 39.

In an aspect of this disclosure, a fluidic interface 2 for a fluid ejection device 1 is provided. The fluidic interface 2 may comprise a single cast 21. The single cast 21 may comprise a fluidic needle 10 for insertion in a fluid cartridge 3 for transporting fluid from the fluid cartridge 3 to a fluid channel 4, and a guide 13, distanced from the needle 10, for guiding the fluid cartridge 3 for inserting the needle 10 in the fluid cartridge 3 when connecting the fluid cartridge 3 to the fluid ejection device 1. In an embodiment, the needle 10 comprises a concentric datum 12 at its base. In an embodiment, the single cast 21 comprises a bottom plate 18 and a standing wall 19. The fluidic needle 10 may protrude away from the standing wall 19. The guide 13 may protrude from the bottom plate 18 for guiding a fluid cartridge 3 into fluidic contact with the needle 10. The fluidic needle 10 and the guide 13 may be aligned to a vertical plane V. In an embodiment, the fluidic interface 2 comprises a secondary fluidic needle 25 protruding from the standing wall 19, for connection to the same cartridge 3 as the first fluidic needle 10, also aligned to the vertical plane V. In an embodiment, the fluidic interface 2 comprises a connector arrangement 22 mounted on top of the standing wall 19, opposite to the bottom plate 18, the connector arrangement 22 comprising an electrical connector 15 arranged to connect to a corresponding fluid cartridge electrical connector 17 by moving the fluid cartridge 3 along the guide 13 in the direction AA of the fluidic needle 10. In a further embodiment, the connector arrangement 22 comprises a datum element 14 extending next to the electrical connector 15, arranged to guide and maintain an electrical connection.

In an embodiment, the fluidic interface 2 comprises a datum 14 for allowing insertion of a cartridge 3 comprising a corresponding second datum 16. The cartridge 3 may also comprise a predetermined fluid type. The single cast 21 may comprise a bottom plate 18 and a standing wall 19, and a fluid channel 5 extending through the bottom plate 18 and the standing wall 19 for directing the fluid from the respective fluidic needle 10 to a respective further fluid channel 7 for the predetermined fluid type of the cartridge 3.

In an embodiment, the single cast 21 comprises (i) multiple fluidic needles 10 each arranged to be inserted in a fluid cartridge 3 containing a predetermined fluid type, (ii) multiple guides 13 for guiding the respective fluid cartridges 3 during insertion, (iii) multiple fluid channels 5 in fluidic connection with the fluidic needles 10 so that in use each fluid channels 5 contains a respective one of the predetermined fluid types for delivering the fluid to at least one corresponding further fluid channel 7. In an embodiment, an end 32 of the fluidic needle 10 has a cross sectional moment of inertia of approximately 10 $mm^4$ or less. In a further embodiment, a concentric datum 12 at the base of the needle 10 has a cross sectional moment of inertia of between approximately 20 $mm^4$ and approximately 300 $mm^4$. In an embodiment, the single cast 21 comprises a T-rail guide 13, arranged to limit the movement of the cartridge 3 to a translation towards and away from the fluidic needle 10. It will be clear that inherent tolerances and margins of the molded material may allow for small movements in other directions.

In a further aspect, a method of manufacturing a fluidic interface 2 is provided. In an embodiment, the method comprises (i) integrally molding a single cast 21 comprising a fluidic needle 10 for insertion in a fluid cartridge 3, and a guide 13, distanced from the fluidic needle 10, (ii) connecting the single cast 21 to a fluid ejection assembly 39 so that (I) the needle 10 is in fluidic connection with at least one further fluid channel 7, 8, 9 of the fluid ejection assembly, and (II) in use a fluid cartridge 3 can be guided along the guide 13 and its fluid is brought into fluidic connection with the further fluid channel 7, 8, 9. In an embodiment, the single cast 21 comprises a standing wall 19 and a bottom plate 18, the needle 10 protruding from the standing wall 19, the guide 13 protruding from the bottom plate 18. In an embodiment of the method, (i) slides 43 are positioned in a mold cavity 42 for fluid channels 5 through the single cast 21, the fluid channels 5 extending from the fluidic needle 10 to a bottom of the single cast 21, and (ii) providing a connector assembly on top of the standing wall, opposite to the bottom plate, the connector assembly comprising an electrical connector and a datum element. In an embodiment of the method, multiple fluid chambers 6 are molded in the bottom plate 18 using a slide 43.

In again a further aspect, a fluid ejection device 1 is provided. In an embodiment, the fluid ejection device 1 comprises (i) at least one nozzle 9 for a predetermined fluid type, and a single cast fluidic interface 21. In an embodiment, the single cast fluidic interface 21 comprises a (i) fluidic needle 10 for the predetermined fluid type for insertion into a fluid cartridge 3 containing the predetermined fluid type, and (ii) a guide 13, spaced away from the needle 10, arranged to guide the fluid cartridge 3 in connection with the fluidic needle 10 so that the fluidic needle 10 is inserted into the fluid cartridge 3. In an embodiment, the single cast fluidic interface 21 is assembled within the fluid ejection device 1 so that the fluidic needle 10 is in fluidic connection with said at least one nozzle 9.

The above description is not intended to be exhaustive or to limit the invention to the embodiments disclosed. Other variations to the disclosed embodiments can be understood and effected by those skilled in the art in practicing the claimed invention, from a study of the drawings, the disclosure, and the appended claims. The indefinite article "a" or "an" does not exclude a plurality, while a reference to a certain number of elements does not exclude the possibility of having more elements. A single unit may fulfil the functions of several items recited in the disclosure, and vice versa several items may fulfil the function of one unit.

In the following claims, the mere fact that certain measures are recited in mutually different dependent claims does not indicate that a combination of these measures cannot be used to advantage. Multiple alternatives, equivalents, variations and combinations may be made without departing from the scope of the invention.

The invention claimed is:

1. Fluidic interface for a fluid ejection device, the fluidic interface comprising:

a single cast integrally molded part, comprising:

a fluidic needle for insertion in a fluid cartridge for transporting fluid from the fluid cartridge to a fluid channel, a bottom plate that supports weight of the fluid cartridge when the fluid cartridge is inserted, and a T-rail guide, protruding from the bottom plate so that a base of the T-rail guide is connected to the bottom plate, the T-rail guide for constricting vertical motion of the fluid cartridge while guiding the fluid cartridge for inserting the needle in the fluid cartridge when sliding the fluid cartridge along the bottom plate to connect the fluid cartridge to the fluid ejection device.

2. Fluidic interface for a fluid ejection device, the fluidic interface comprising:

a single cast, comprising:

a fluidic needle for insertion in a fluid cartridge for transporting fluid from the fluid cartridge to a fluid channel, the needle comprising a concentric datum at its base, a bottom plate that supports weight of the fluid cartridge when the fluid cartridge is inserted, and a T-rail guide, protruding from the bottom plate so that a base of the T-rail guide is connected to the bottom plate, the T-rail guide for guiding the fluid cartridge for inserting the needle in the fluid cartridge when sliding the fluid cartridge along the bottom plate to connect the fluid cartridge to the fluid ejection device.

3. Fluidic interface according to claim 1, wherein the single cast integrally molded part additionally comprising a standing wall, and the fluidic needle protrudes away from the standing wall.

4. Fluidic interface according to claim 3, wherein the fluidic needle and the T-rail guide are aligned to a vertical plane.

5. Fluidic interface according to claim 4, further comprising a secondary fluidic needle protruding from the standing wall, for connection to the same cartridge as the first fluidic needle, also aligned to the vertical plane.

6. Fluidic interface according to claim 3, comprising a connector arrangement mounted on top of the standing wall, opposite to the bottom plate, the connector arrangement comprising an electrical connector arranged to connect to a corresponding fluid cartridge electrical connector by moving the fluid cartridge along the T-rail guide in the direction of the fluidic needle.

7. Fluidic interface according to claim 6, the connector arrangement further comprising a datum element extending next to the electrical connector, arranged to guide and maintain an electrical connection.

8. Fluidic interface for a fluid ejection device, the fluidic interface, the fluidic interface comprising:

a datum, for allowing insertion of a cartridge comprising a corresponding second datum and a predetermined fluid type, a single cast, comprising:

a fluidic needle for insertion in a fluid cartridge for transporting fluid from the fluid cartridge to a fluid channel, a bottom plate that supports weight of the fluid cartridge when the fluid cartridge is inserted, a T-rail guide, protruding from the bottom plate so that a base of the T-rail guide is connected to the bottom plate, the T-rail guide for guiding the fluid cartridge for inserting the needle in the fluid cartridge when sliding the fluid cartridge along the bottom plate to connect the fluid cartridge to the fluid ejection device, a standing wall, and a fluid channel extending through the bottom plate and the standing wall for directing the fluid from the respective fluidic needle to a respective further fluid channel for the predetermined fluid type of the cartridge.

9. Fluidic interface according to claim 1, the single cast integrally molded part comprising multiple fluidic needles each arranged to be inserted in a fluid cartridge containing a predetermined fluid type, multiple guides for guiding the respective fluid cartridges during insertion, multiple fluid channels in fluidic connection with the fluidic needles so that in use each fluid channels contains a respective one of the predetermined fluid types for delivering the fluid to at least one corresponding further fluid channel.

10. Fluidic interface according to claim 1, wherein an end of the fluidic needle has a cross sectional moment of inertia of approximately 10 $mm^4$ or less.

11. Fluidic interface according to claim 1, comprising a concentric datum at a base of the needle, having a cross sectional moment of inertia of between approximately 20 $mm^4$ and approximately 300 $mm^4$.

12. Fluidic interface according to claim 1, wherein the T-rail guide is arranged to limit the movement of the cartridge to a translation towards and away from the fluidic needle.

* * * * *